US007089615B1

(12) United States Patent
Parimuha

(10) Patent No.: US 7,089,615 B1
(45) Date of Patent: Aug. 15, 2006

(54) ERGONOMIC WEDGE PILLOW

(76) Inventor: Carl Parimuha, 2822 E St., Eureka, CA (US) 95501

( * ) Notice: Subject to any disclaimer, the term of this patent is extended or adjusted under 35 U.S.C. 154(b) by 199 days.

(21) Appl. No.: 10/839,612

(22) Filed: May 4, 2004

Related U.S. Application Data

(60) Provisional application No. 60/506,691, filed on Sep. 26, 2003.

(51) Int. Cl.
*A47G 9/00* (2006.01)

(52) U.S. Cl. ..... 5/636; 5/645

(58) Field of Classification Search ..... 5/636, 5/638, 637, 640, 641, 643, 645
See application file for complete search history.

(56) References Cited

U.S. PATENT DOCUMENTS

| | | | | | |
|---|---|---|---|---|---|
| 1,890,358 | A | * | 12/1932 | Barcalo | 5/636 |
| 2,877,472 | A | * | 3/1959 | Wagner | 5/636 |
| 3,411,164 | A | * | 11/1968 | Sumergrade | 5/644 |
| 4,679,262 | A | * | 7/1987 | Davis et al. | 5/644 |
| 5,038,432 | A | * | 8/1991 | Robillard et al. | 5/645 |
| 5,088,141 | A | | 2/1992 | Meyer et al. | |
| 5,237,714 | A | * | 8/1993 | Baron | 5/636 |
| D396,373 | S | | 7/1998 | Reale | |
| 5,829,079 | A | * | 11/1998 | Castro | 5/636 |
| 5,987,674 | A | | 11/1999 | Schaffner et al. | |
| D431,143 | S | | 9/2000 | Sekelsky | |
| D448,228 | S | | 9/2001 | Davis et al. | |
| D466,751 | S | | 12/2002 | Coats et al. | |
| 6,708,353 | B1 | * | 3/2004 | Han | 5/632 |

* cited by examiner

*Primary Examiner*—Alexander Grosz
(74) *Attorney, Agent, or Firm*—Richard S. Erbe

(57) ABSTRACT

A pillow to provide predictable support for a reclining person during sleep or therapy. The preferred embodiment of the invention is formed by a continuous portion forming two openings, at which are joined side panels. The pillow is generally shaped as an adjustable wedge, which can be used by a person in the stomach lying, back lying, or side lying positions to provide proper support and comfort. The pillow is filled with a material that allows the user to shape the pillow to conform the pillow to the individual physical makeup and personal preferences of the user.

In another embodiment of the invention, a pair of internal panels, each one adjacent one of the side panels, divides the pillow into compartments which can be individually filled. This embodiment of the invention constitutes a large triangular shaped wedge pillow with internal panels that mirror the side panel angle that creates a pair of secondary wedges upon which are formed the support areas of the person's cheekbone and forehead areas.

18 Claims, 6 Drawing Sheets

ERGONOMIC WEDGE PILLOW

RELATED APPLICATIONS

This application claims the benefit of U.S. Provisional Patent Application No. 60/506,691, filed Sep. 26, 2003, incorporated herein by reference.

BACKGROUND OF THE INVENTION

1. Field of the Invention

The present invention relates to pillows, and more particularly, to an ergonomically wedge-shaped pillow that is designed to act as a fulcrum, with a person's head and neck becoming a flexible bar so that the pillow and the person's head and neck work together in unison, with the spine maintaining ergonomically normal postures as they pivot about the pivot points provided by the pillow.

2. General Background and State of the Art

Human beings spend about a third of their lives sleeping. The standard pillow that most people use during sleep is a rectangular pillow. Such a pillow provides poor sleeping support for the user. The support that is provided is generally uneven and can result in sleep disorders, serious discomfort and no relief from preexisting conditions, such as sciatica, low back pain, hip flexures, pelvic distortion, neck pain, impaired breathing, and shoulder dysfunction. A person who sleeps on the stomach with a standard rectangular pillow will often experience neck pain, which not only is a source of discomfort, but may also cause the person to forego the stomach sleeping position.

Ideally, a pillow should maintain a user's head and ears over the shoulders without much rotation of the neck.

A pillow should be configured so that when a user is lying on his or her side, the shoulder is slightly behind or ahead of the chest wall while still maintaining a user's head and ears over the shoulders without much rotation of the neck.

A pillow should be able to be used during sleep or as a therapeutic device in conjunction with a torso or a foot pillow to allow the user to lie on his or her left or right side stomach position to take pressure off of ankles, knees, and toes.

A pillow should be soft in any reclining position. When a person is lying on their side, back or stomach, the pillow should maintain the alignment of the spine.

A pillow should be adjustable by the user and provide even distribution of the load at the shoulders and upper back.

Ideally, the pillow should be compact, lightweight, and not include a number of spaced extension elements, which may take up valuable, or perhaps require unavailable, space.

Several prior art pillows for providing comfort and support to a reclining person are known. U.S. Pat. No. 5,088,141 to Meyer, et al., discloses a pillow with a generally rectangular shape with four slightly concaved sides. The Meyer, et al., pillow also includes an irregular-shaped hollow in its center. The pillow is designed to support a person lying on his or her back and left and right sides. Meyer, et al., is not designed to support a person lying on their stomach.

U.S. Pat. No. 3,327,330 to McCullough discloses an L-shaped pillow with a central body having two extension wing members that are joined on either side of the body by a traverse seam.

U.S. Pat. No. 4,060,863 to Craig discloses a substantially V-shaped pillow tapered so that the body presents a substantially flat surface from top to bottom when the arms are folded in contact with each other.

U.S. Pat. No. 4,731,890 to Roberts discloses a pillow designed to aid a mother during breast feeding. The pillow has a V-shape having one arm of the perpendicular V-shape wider than the other.

U.S. Pat. No. 4,173,048 to Varaney discloses a body-length pillow with a linear head supporting central portion having two body length extensions extending perpendicularly from the ends of the central portion.

U.S. Pat. No. 4,574,412 to Smith discloses an L-shaped pillow having a linear head supporting portion with a linear leg portion extending perpendicularly therefrom.

U.S. Pat. No. 4,754,510 to King discloses a pillow having a pair of generally oval or elliptical shaped portions attached perpendicularly to each other.

U.S. Pat. No. 4,794,657 to Avery discloses a pillow assembly having a trunk with a head and leg pillow which may be removably attached in different rotational orientations to the trunk pillow.

The above pillows, excepting the Meyer, et al., pillow, are not compact in design and comprise a combination of linear members extending either linearly or essentially perpendicularly from each other.

There is no pillow designed to provide adequate support and proper body alignment for a user lying on their back, stomach or sides and that is compact and adjustable.

SUMMARY OF THE INVENTION

Accordingly, it is an object of the invention to provide a pillow for supporting the head and neck of a human that is compact and can easily be adjusted to an individual user's personal physique.

Another object of the invention to provide a pillow for supporting the head and neck of a human that can provide adequate support for a person whether lying on their back, stomach, or side.

An additional object of the invention to provide a pillow for supporting the head and neck of a human that can be used in conjunction with a torso pillow and/or a foot pillow.

It is yet another object of the invention to provide a pillow for maintaining the proper positional relationship of a person's head, neck and shoulders with the chest wall when the person is lying on their stomach, side, or back, or other variations of these positions with the use of support pillows under the torso or feet.

A further object of the invention to provide a pillow for supporting the head and neck of a human that is versatile and has several areas for contact by the user.

Still another object of the invention to provide a pillow for supporting the head and neck of a human that maintains a proper posture of the spine when a person is lying on his or her side, stomach, or back.

These and other objectives are achieved by the present invention, which, in a broad aspect, provides the user with a pillow, generally in the shape of a wedge or triangle, made of a durable material with a flexible, conforming filler material. In the preferred embodiment of the invention, a continuous piece forms an enclosure with a pair of opposed openings. The continuous piece forms the front, back, top and bottom portions of the pillow.

A pair of side panels cover the two openings formed by the enclosure. Within the enclosure is placed a filler material. In the preferred embodiment of the invention, the filler is a shredded fleece. The filler material may be placed within the pillow by means of a zipper in the bottom surface of the pillow.

The pillow also features a shank sewed onto its outer surface to assist in aligning the position of the head and neck of a user when the user lies on their back.

A crest is formed in the pillow between the front and back of the outer surface of the pillow, giving the pillow its wedge-shaped or triangular configuration. The crest provides the support point for the head and neck of the user in certain positions. The crest may form a range of angles from obtuse to oblique, thus providing a great degree of versatility to the pillow.

At the back of the pillow, where the continuous piece is joined by the side panels, a pair of tips is formed. The user may pull on the tips to further adjust the shape and contours of the pillow while lying on the back or may use them in a support fashion when lying on their side and leaning toward the back, where the pillow tip or crest is actually supporting the shoulder blade.

The pillow may be used by a person lying on their side, with the user's neck cradled over the crest, where the ear is centered at the shank area, forming a range of angles.

The pillow may be used by a person lying on their side with the crook of the user's neck filled by the back of the pillow.

The pillow may be used by a person lying on their stomach, with the user's forehead located at the crest allowing space for the nose to assist in breathing.

The pillow may be used by a person lying on their back, using the crest to locate the person's neck.

The pillow may be used as a "column" to support a user lying on their side. In this position, the head is placed between the front portion and the crest of the pillow.

In another embodiment of the invention, the pillow includes a pair of panels located inside the pillow, similar in configuration to the side panels. The internal panels divide the pillow into a number of compartments. By accessing the inside of the pillow by means of the zipper located on the bottom of the pillow, one may vary the amount and location of the filler material between the compartments, thus enabling the user to adjust the density of the pillow to suit the particular individual.

Provision of the panels creates a wedge shape on the left side as well as on the right side of the pillow, while the pillow maintains its overall wedge shape.

Using the internal panels allows a person lying on their stomach and side to properly locate the best position for their forehead and cheekbone, allowing space to breathe and providing proper posture alignment of the spine where the ears are over the shoulders and where there is little or limited head rotation.

Further objects and advantages of this invention will become more apparent from the following description of the preferred embodiment, which, taken in conjunction with the accompanying drawings, will illustrate, by way of example, the principles of the invention.

BRIEF DESCRIPTION OF THE DRAWINGS

The foregoing and other objects, aspects and advantages will be better understood from the following detailed description of the preferred embodiments of the invention with reference to the drawings in which.

DETAILED DESCRIPTION OF THE PREFERRED EMBODIMENTS OF THE INVENTION

Figure 1:
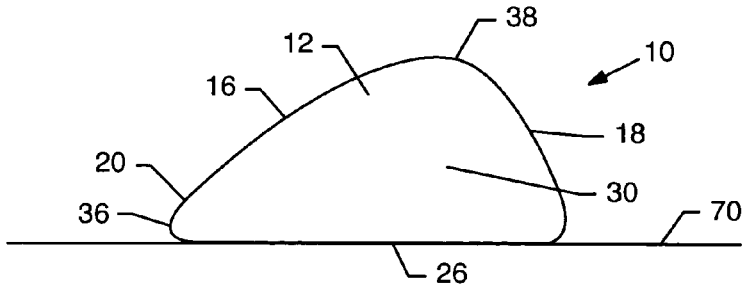
FIG. 1 illustrates a side elevation view of an exemplary pillow according to the present invention.

In the following description of the present invention, reference is made to the accompanying drawings, which form a part thereof, and in which are shown, by way of illustration, an exemplary embodiment illustrating the principles of the present invention and how it may be practiced. It is to be understood that other embodiments may be utilized to practice the present invention, and structural and functional changes may be made thereto without departing from the scope of the present invention. The reference numerals for like parts have been maintained through the different embodiments depicted in the drawings.

Figure 2:
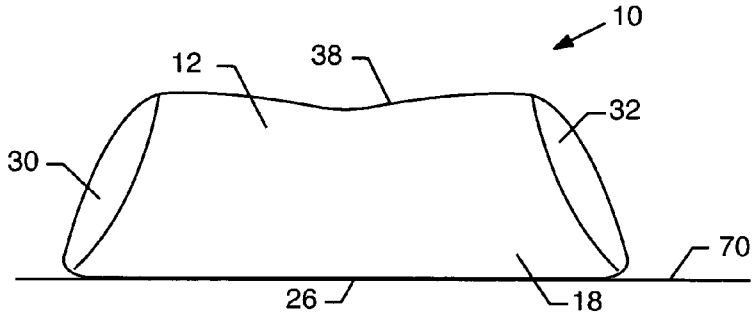
FIG. 2 illustrates a front elevation view of an exemplary pillow according to the present invention.
Figure 3:
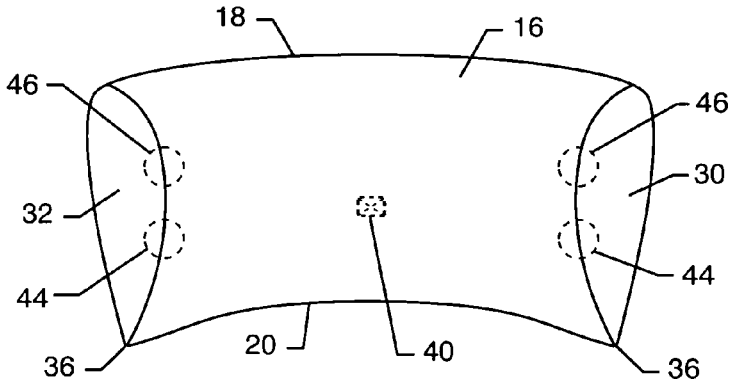
FIG. 3 illustrates a top view of an exemplary pillow according to the present invention.

An ergonomic wedge pillow in accordance with the present invention is illustrated in FIGS. 1 through 4 and generally referred to by the reference numeral 10. Pillow 10 is generally in the shape of a wedge or triangle as it rests on surface 70. Exterior 12 includes upper portion 16, front end 18, back end 20, and bottom portion 26. Between upper portion 16 and front end 18 is a crest 38, which may be configured in a range of angles, ranging from obtuse to acute, depending on the needs and physical makeup of a user. FIGS. 2 and 3 also illustrate first side panel 30 and second side panel 32, which join exterior 12 to form an enclosure, in which is contained a filler material. In the preferred embodiment of the invention, side panels 30 and 32 are joined to exterior 12 by stitching, and the filler material consists of shredded fleece, although a variety of materials that allows the pillow 10 to be shaped in a desired configuration may be utilized.

FIG. 3 shows alignment shank 40, which is utilized to align the head and neck of an individual when using the pillow in certain positions, as will be discussed later. Shank 40 is located on upper portion 16 between crest 38 and back end 20. As also illustrated in FIG. 3, tips 36, located at back end 20, provide back end 20 with a slightly concave shape. Tips 36 may be adjusted by a user to further adapt the configuration of pillow 10 to a desired configuration.

Figure 4:
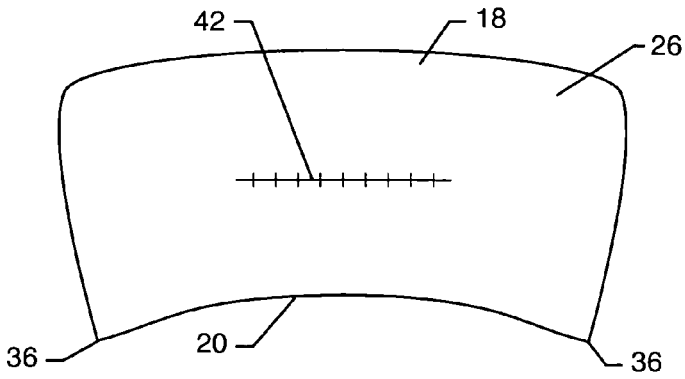
FIG. 4 illustrates a bottom view of an exemplary pillow according to the present invention.

As illustrated in FIG. 4, bottom portion 26 also includes zipper 42, which may be used to open exterior 12 and insert or take away filler material from pillow 10, as may be desired.

Figure 5:
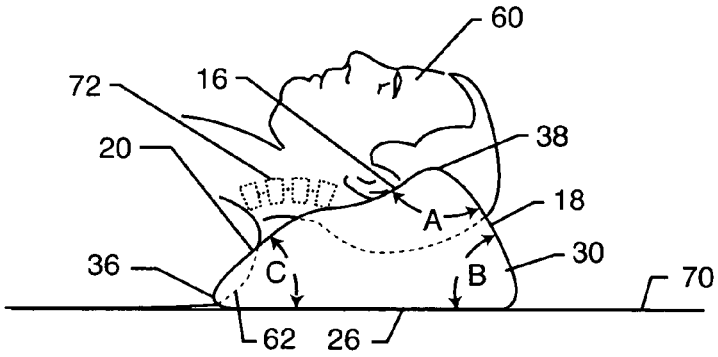
FIG. 5 illustrates a side elevation view of an exemplary pillow according to the present invention showing a user lying on the back.

Pillow 10, when viewed from the side, as illustrated in FIG. 1 and FIG. 5, takes on the general shape of a wedge or triangle. Angles A, B, and C shown in FIG. 5 may take on a wide range of angles, depending upon the particular use, physical features of a user, and the preferences of the user. In the preferred embodiment of the invention, angle A is 70°, angle B is 65°, and angle C is 45°; however, the invention may be formed with a variety of angles without departing from the scope of the invention.

Figure 6:
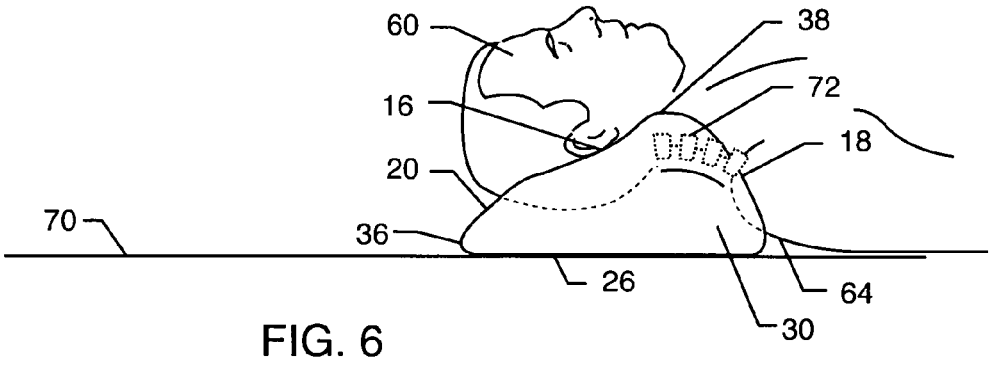
FIG. 6 illustrates a side elevation view of an exemplary pillow according to the present invention showing a user lying on the back with the crest of the pillow located at the back of the user's neck.

FIGS. 5 and 6 illustrate a user 60 using pillow 10 while lying on the back. In FIG. 5, pillow 10 is placed under the neck so that the back of the head comes into contact with alignment shank 40. Pillow 10 may be adjusted by gathering pillow material with either hand and pulling on pillow tips 36 above the shoulders in the direction of the user's feet, thereby increasing the curve of the spine 72 to provide user 60 with the most comfortable position.

FIG. 6 illustrates another use of pillow 10 by user 60 lying on the back. In the position, alignment shank 40 comes into contact with the back of the head of user 60, and the pillow is adjusted by rolling crest 38 towards the feet of user 60 to provide the most optimal position for spine 72.

Figure 7:
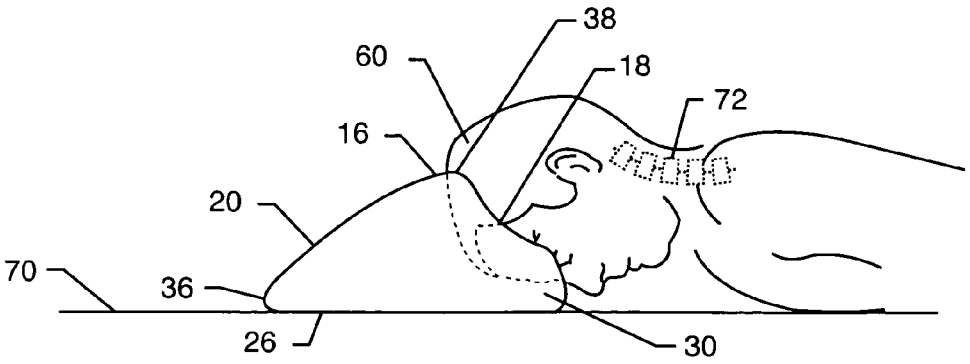
FIG. 7 illustrates a side elevation view of an exemplary pillow according to the present invention showing a user lying on the stomach.

FIG. 7 illustrates the use of pillow 10 by user 60 lying on the stomach. In this position, the forehead of user 60 comes into contact with crest 38. The compressive forces of the head of user 60 on crest 38 will provide a free area for the nose of user 60 so that breathing can occur normally.

Figure 8:
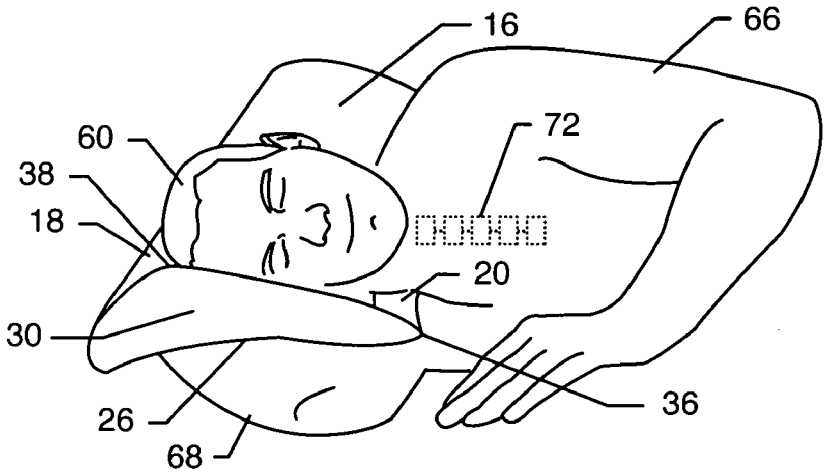
FIG. 8 illustrates a side view of an exemplary pillow of the present invention, with a user lying on their side and with the pillow tips oriented towards the user's feet.

FIG. 8 shows pillow 10 being used by user 60 while lying on one side. The flexible nature of pillow 10 allows user 60 to make the invention conform to his or her particular preferences by adjusting tips 36 or changing the amount of filler material inside pillow 10. In FIG. 8, user 60 positions right arm 68 beneath bottom portion 26 to gather front end 18 to tighten the fit of the wedge to the crook of the neck, while left arm 66 is away from the surface. The use of a pillow 10 as a wedge helps micromanage head and neck postures for optimal comfort.

Figure 8A:
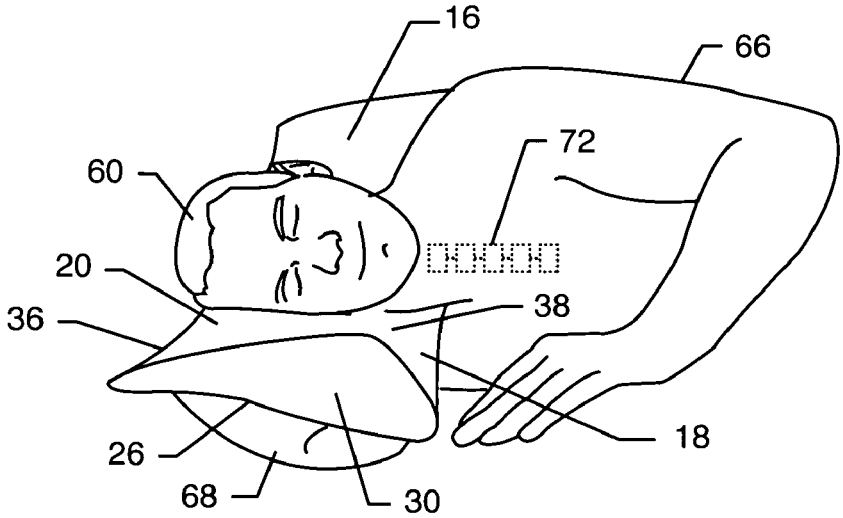
FIG. 8A illustrates a side view of an exemplary pillow of the present invention, with a user lying on their side and with the pillow tips oriented away from the user's feet and the user's neck over the crest.

FIG. 8A shows pillow 10 being used by user 60 while lying on one side, with crest 38 positioned between the head and neck and spine 72 in proper alignment. This position further illustrates the many ways in which pillow 10 may be utilized. It differs from the position of user 60 in FIG. 8 in that in FIG. 8, the head is positioned between crest 38 and back end 20.

Figure 9:
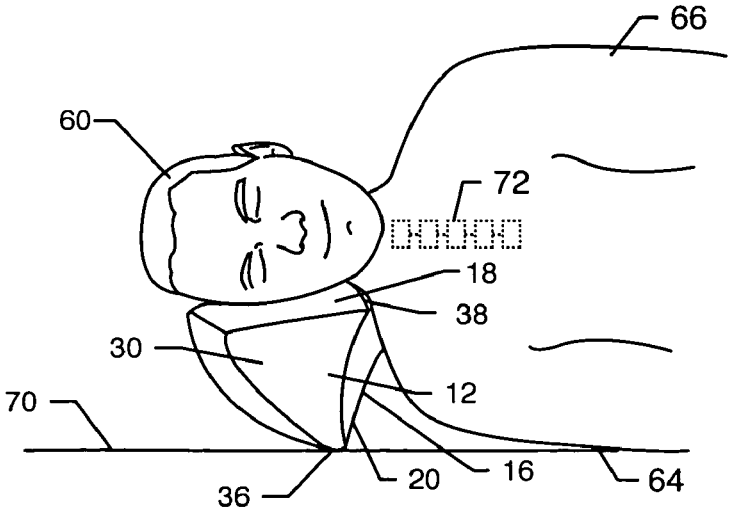
FIG. 9 illustrates a side view of an exemplary pillow of the present invention with the invention utilized as an adjustable wedge that can tilt at the apex toward the feet or toward the top of the head.

FIG. 9 illustrates user 60 in the side lying position, with the tips 36 becoming the pivot point, and the head contacting the front end 18 of pillow 10 with crest 38 at approximately where the head and neck join. When user 60 contacts pillow 10 in the side lying position, user 60 can pivot the crest 38 up, away from the neck, or down, toward the neck, to fit the comfort needs of user 60. To achieve an adjustable surface pillow 10 should be rotated about tips 36 prior to compressing pillow 10 by the head and neck. A multitude of angles is available at the pivot area formed at tips 36. With weight added to pillow 10 by the head and neck of user 60, a slight but significant change occurs in the compression of pillow 10. Variable compression at different angles provides variable support for user 60, allowing user 60 to alter pillow 10 to fit his or her comfort requirements.

The requirement to rotate the head on the neck into uncomfortable positions is therefore minimized. The support provided by pillow 10 as illustrated in FIG. 9, where pillow 10 forms an adjustable wedge, allows for the ears and shoulders of the user to be positioned more in parallel to each other and the head and neck to be more closely aligned at right angles to the shoulders, providing further comfort to the user and more consistent positioning to the user.

FIGS. 10 through 13 illustrate an alternative embodiment of the invention. First interior panel 50 and second interior panel 52 are located in interior 14 to form a plurality of compartments designated 54, 56, and 58. The inclusion of interior panels 50 and 52 adds two additional wedge shapes to the pillow. By means of zipper 42 in bottom portion 26, filler material 34 may be added or taken away from any of the compartments 54, 56, and 58 to alter the density of pillow 10 according to a user's preference.

Figure 10:
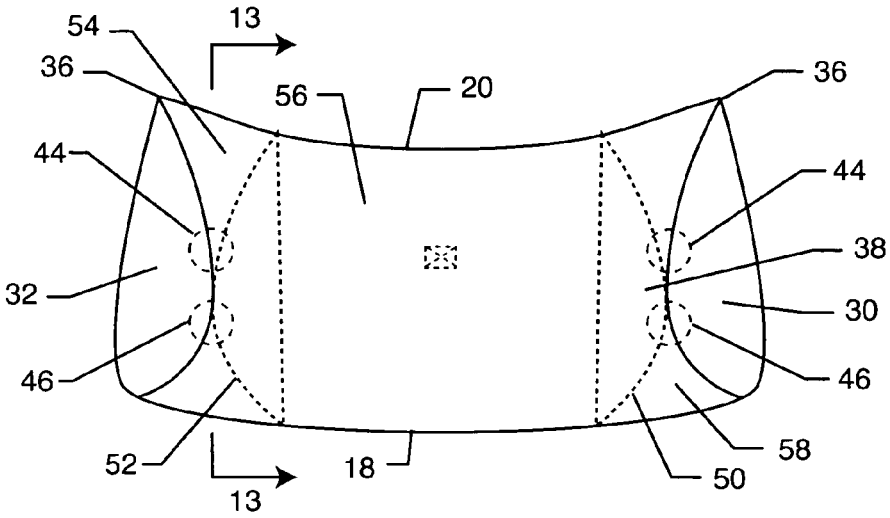
FIG. 10 illustrates a top view of an alternative embodiment of an exemplary pillow of the present invention.
Figure 11:
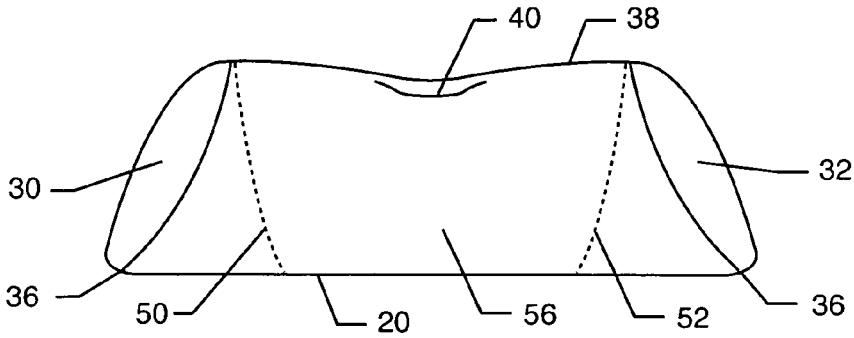
FIG. 11 illustrates a rear elevation view of an alternative embodiment of an exemplary pillow of the present invention.
Figure 12:
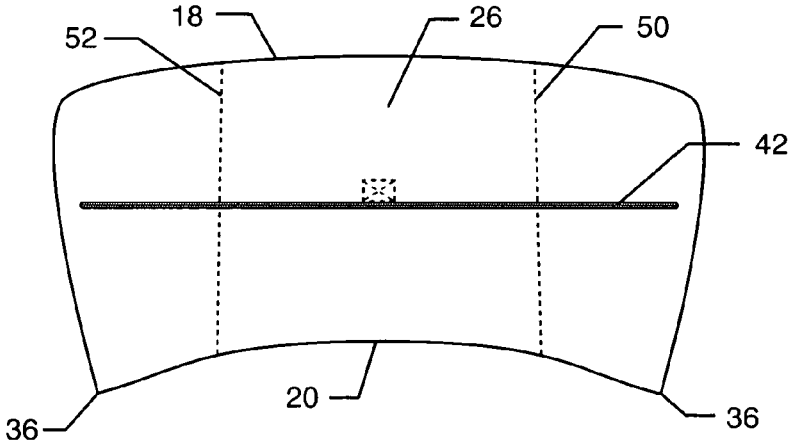
FIG. 12 illustrates a bottom view of an alternative embodiment of an exemplary pillow of the present invention.
Figure 13:
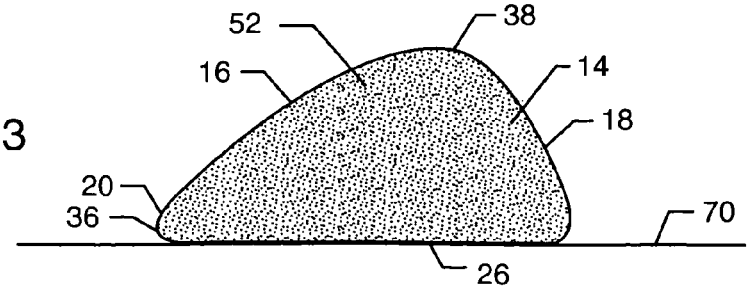
FIG. 13 illustrates a sectional view taken at line 13—13 in FIG. 10.

As illustrated in FIG. 10, the addition of interior panels 50 and 52 (shown in dotted lines), in combination with side panels 30 and 32 in close proximity with crest 38 provide further advantages to the stomach and side-lying user of pillow 10 by forming cheekbone support areas 46 and forehead support areas 44 on both the right and left sides of pillow 10.

A person lying face down with a slight torso and head rotation to the left or right finds added support to the cheekbone at cheekbone support area 46 and to the forehead at forehead support area 44. The weight of the head is supported by cheekbone support area 46 and forehead support area 44 of pillow 10 where they intersect with either side panel 30 or side panel 32. The support of the neck may be accomplished by moving the right side of pillow 10 into the hollow formed by the head and shoulder. When support areas 46 and 44 are used correctly, the user sleeping on the stomach is provided with a consistent supporting ergonomic position while maintaining normal cervical curves without head rotation, thereby providing an ergonomically consistent posture.

Figure 14:
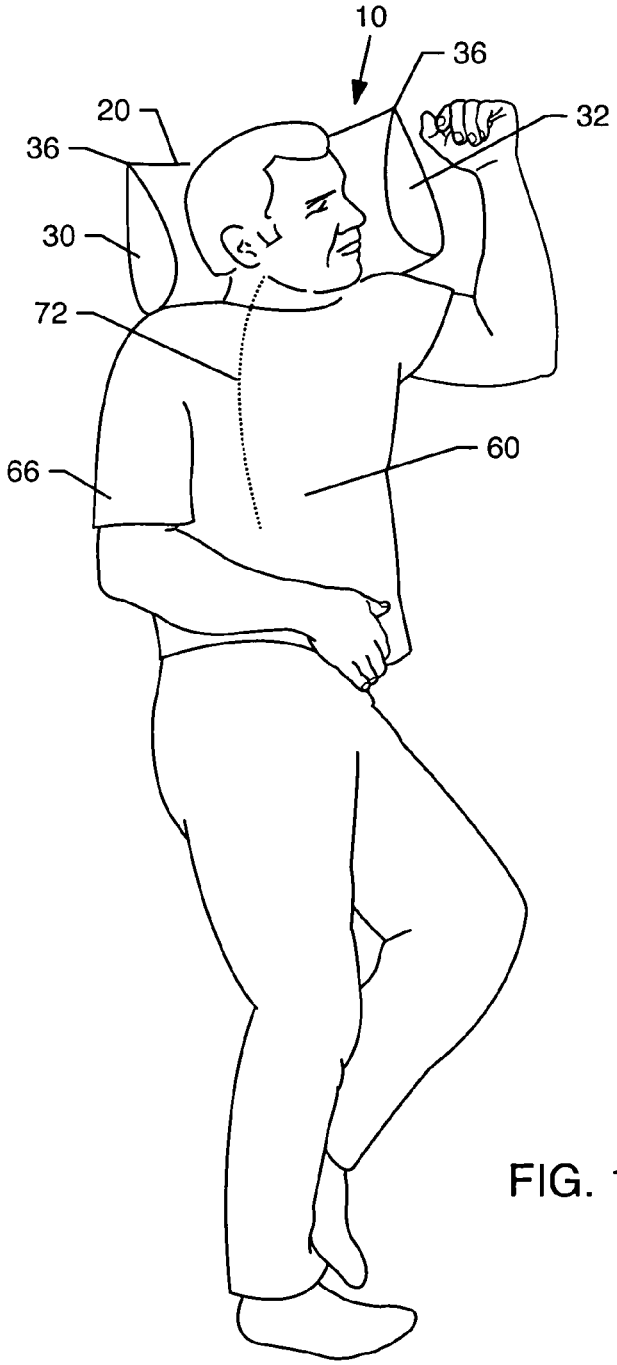
FIG. 14 illustrates a top view of a user lying on their side while using an exemplary pillow of the present invention.
Figure 15:
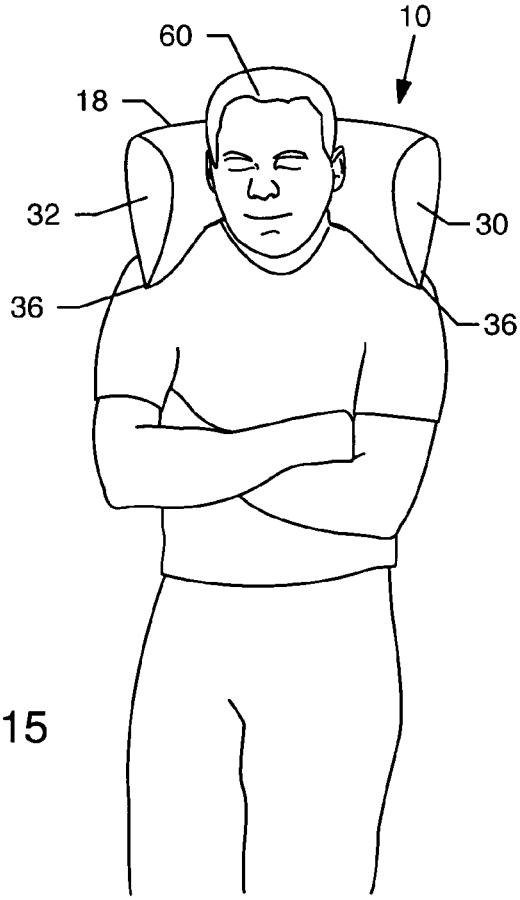
FIG. 15 illustrates a top view of a user lying on their back while using an exemplary pillow of the present invention.
Figure 16:
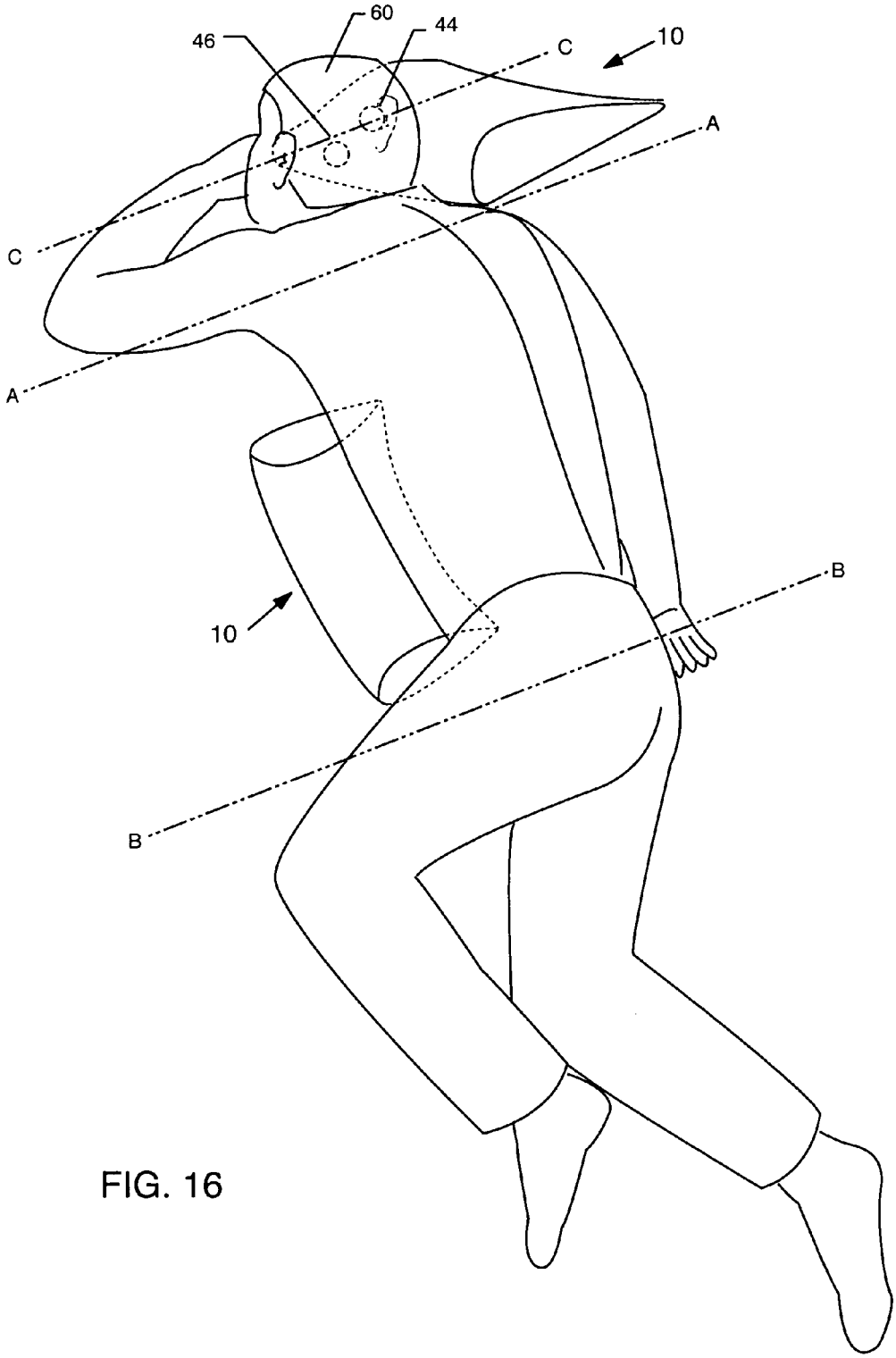
FIG. 16 illustrates a top view of a user utilizing two exemplary pillows of the present invention.

FIGS. 14, 15 and 16 are further illustrations of the variety of uses and versatility of the present invention. FIG. 14 shows user 60 lying on their side, with back end 20 oriented away from the user's feet. Crest 38 is located where the head and neck join. User 60 lies on his or her left side with the torso turned to the right. Right arm 66 is primarily positioned behind the chest cavity, and spine 72 is in the proper alignment.

FIG. 15 shows user 60 lying on the back with tips 60 oriented towards the user's feet. Pillow tips 36 are positioned above the user's shoulders. Shank 40 (not shown) is used to properly position the head on pillow 10.

FIG. 16 illustrates using more than one pillow 10 of the present invention. User 60 uses one pillow to support the head and neck and a second or bolster pillow under the torso. Use of the two pillows allows the line of the shoulders (line A—A) to be parallel to the line of the hips (line B—B) and the line of the ears (line C—C) for best comfort. Support areas 44 and 46 add to the comfort of user 60.

The foregoing description of exemplary embodiments of the present invention has been presented for purposes of enablement, illustration, and description. It is not intended to be exhaustive of or to limit the present invention to the precise forms discussed. There are, however, other configurations for pillows not specifically described herein, but with which the present invention is applicable. The present invention should therefore not be seen as limited to the particular embodiments described herein; rather, it should be understood that the present invention has wide applicability with respect to pillows. Such other configurations can be achieved by those skilled in the art in view of the description herein. Accordingly, the scope of the invention is defined by the following claims.

What is claimed is:

1. A pillow comprising:

a continuous element forming an interior and an exterior and two opposed openings, said continuous element including an upper portion having an upper end, a concave-shaped back end, a front end and a bottom portion extending between said front and back ends;

a flexible filling material;

a generally triangular first side panel and a generally triangular second side panel joined to said continuous element at said opposed openings forming a right side and a left side of the pillow;

a pair of adjustable tips formed where said first and second side panels join said continuous element at the back end, said tips and said flexible filling material allowing the shape and contours of the pillow to be adjusted; and a rounded crest formed on said upper portion between said front and back ends and extending between said first side panel and said second side panel.

2. The pillow according to claim 1, further comprising:

a first interior panel disposed adjacent said first side panel inside said interior; and a second interior panel disposed adjacent said second side panel inside said interior;

whereby, said pillow is configured overall having a wedge shape as well as having a wedge shape on the left side and right side of the pillow.

3. The pillow according to claim 2 further having a plurality of compartments formed between said first side panel and said first interior panel, between said first interior panel and said second interior panel, and between said second interior panel and said second side panel.

4. The pillow according to claim 2 wherein said first and second interior panels are attached to said continuous element by stitching.

5. The pillow according to claim 1 further having an alignment shank sewn on said upper portion between said front end and said crest for aligning the head and neck of an individual and maintain proper positional relationship between the head, neck and shoulders of an individual lying on the back or lying in a combined back and side position.

6. The pillow according to claim 1, further having a plurality of support areas for the forehead and cheekbone of a human head formed on the exterior at the intersection of each said side panel and each said interior panel.

7. The pillow according to claim 1, wherein said crest provides support for the head and neck of a reclining user.

8. The pillow according to claim 1, wherein said adjustable tips may be positioned above a user's shoulders when a user is lying on their back, thereby changing the angle of the spine by changing the angle of the pillow.

9. The pillow according to claim 1, wherein said adjustable tips may be positioned to support a user's shoulder blades while the user is in the combined side and back position.

10. A pillow for supporting the head and neck comprising:

an upper portion having a front end and a concave-shaped back end and two outer sides;

a bottom portion having four edges along its periphery joined to said upper portion at said front end and said back end by two of said edges, said upper portion and said bottom portion forming an interior;

a pair of opposed generally triangular side panels joined to said upper portion and said bottom portion adjacent said outer sides of said upper portion and two of said edges of said bottom portion forming a right side and a left side of the pillow;

a flexible filler material in the enclosed area formed by said upper portion, said lower portion and said side panels;

a pair of adjustable tips formed where said side panels join said bottom portion and said upper portion at the back end, said tips and said flexible filler material allowing the shape and contours of the pillow to be adjusted; and a rounded crest formed on said upper portion between said front and back ends and extending between said side panels.

11. The pillow according to claim 10 further comprising:

a first interior panel disposed adjacent one of said side panels inside said interior; and a second interior panel disposed adjacent one of said side panels inside said interior, whereby, said pillow is configured overall having a wedge shape as well as having a wedge shape on the left side and right side of the pillow.

12. A pillow according to claim 11 further having an alignment shank sewn on said upper portion between said front end and said crest for aligning the head and neck of an individual and maintain proper positional relationship between the head, neck and shoulders of an individual lying on the back or lying in a combined back and side position.

13. The pillow according to claim 11, further having a plurality of support areas for the forehead and cheekbone of a human head on the upper portion formed at the intersection of each said side panel and each said interior panel.

14. The pillow according to claim 11 further having a plurality of compartments formed by said interior panels and said side panels.

15. The pillow according to claim 10, wherein said crest provides support for the head and neck of a reclining user.

16. The pillow according to claim 10, wherein said adjustable tips may be positioned above a user's shoulders when a user is lying on their back, thereby changing the angle of the spine by changing the angle of the pillow.

17. The pillow according to claim 10, wherein said adjustable tips may be positioned to support a user's shoulder blades while the user is in the combined side and back position.

18. A method of using an ergonomic pillow in a variety of support positions by a person, the method comprising the steps of:

providing a wedge-shaped pillow having an upper portion, a bottom portion, a front end, a concave back end, two generally triangular side panels, a rounded crest formed on said upper portion between said front and back ends and extending between said side panels, and a pair of adjustable tips formed on said back end;

filling the pillow with a flexible material;

placing the pillow on a surface with the tips contacting the surface;

placing the head of the person on the pillow, thereby compressing the pillow; and pivoting the pillow about the tips.

* * * * *